US009126263B2

(12) United States Patent
Schwellenbach et al.

(10) Patent No.: US 9,126,263 B2
(45) Date of Patent: Sep. 8, 2015

(54) CSP-CONTINUOUS CASTING PLANT WITH AN ADDITIONAL ROLLING LINE

(71) Applicant: SMS Siemag AG, Duesseldorf (DE)

(72) Inventors: Joachim Schwellenbach, Duesseldorf (DE); Heribert Neifer, Dinslaken (DE); Dieter Rosenthal, Niederfischbach (DE)

(73) Assignee: SMS GROUP GMBH, Duesseldorf (DE)

( * ) Notice: Subject to any disclaimer, the term of this patent is extended or adjusted under 35 U.S.C. 154(b) by 17 days.

(21) Appl. No.: 14/098,969

(22) Filed: Dec. 6, 2013

(65) Prior Publication Data

US 2014/0083644 A1 Mar. 27, 2014

Related U.S. Application Data

(63) Continuation-in-part of application No. 12/928,386, filed on Dec. 9, 2010, now abandoned, which is a continuation-in-part of application No. 11/579,932, filed as application No. PCT/EP2005/012900 on Dec. 2, 2005, now abandoned.

(30) Foreign Application Priority Data

Dec. 3, 2004 (DE) ..... 10 2004 058 550

(51) Int. Cl.

| | |
|---|---|
| ***B22D 11/14*** | (2006.01) |
| ***B22D 11/12*** | (2006.01) |
| ***B21B 1/46*** | (2006.01) |
| ***B21B 13/22*** | (2006.01) |

(52) U.S. Cl.

CPC . *B22D 11/14* (2013.01); *B21B 1/46* (2013.01); *B21B 13/22* (2013.01); *B22D 11/12* (2013.01); *B22D 11/1206* (2013.01); *B22D 11/142* (2013.01)

(58) Field of Classification Search

CPC ..... B21B 1/46; B21B 1/463; B21B 13/22; Y10T 29/49988; Y10T 29/49989; Y10T 29/49991; Y10T 29/5184; B22D 11/12; B22D 11/1206; B22D 11/14

See application file for complete search history.

(56) References Cited

U.S. PATENT DOCUMENTS

| | | | | |
|---|---|---|---|---|
| 4,310,031 | A * | 1/1982 | Appel et al. | 140/2 |
| 4,320,646 | A * | 3/1982 | Bindernagel et al. | 72/201 |
| 4,363,394 | A * | 12/1982 | Kirchhoff | 198/369.1 |
| 6,978,531 | B1 * | 12/2005 | Che et al. | 29/527.7 |
| 7,143,499 | B2 * | 12/2006 | Seidel et al. | 29/527.7 |
| 8,011,418 | B2 * | 9/2011 | Rosenthal et al. | 164/476 |
| 2004/0244460 | A1 * | 12/2004 | Xiong | 72/405.01 |
| 2007/0137505 | A1 * | 6/2007 | Heid et al. | 100/144 |

FOREIGN PATENT DOCUMENTS

WO 2009121678 A1 * 10/2009

* cited by examiner

*Primary Examiner* — Edward Tolan

(74) *Attorney, Agent, or Firm* — Abelman, Frayne & Schwab

(57) ABSTRACT

A continuous casting plant (1) includes at least one continuous casting line, optionally, at least one reducing unit, at least one separation device, and one or more devices for tempering the strip, and at least one auxiliary rolling line is arranged parallel to the continuous casting line with conveyors (10, 10') for continuously inwardly transferring different slab formats into the line of the continuous casting plant (1).

6 Claims, 1 Drawing Sheet

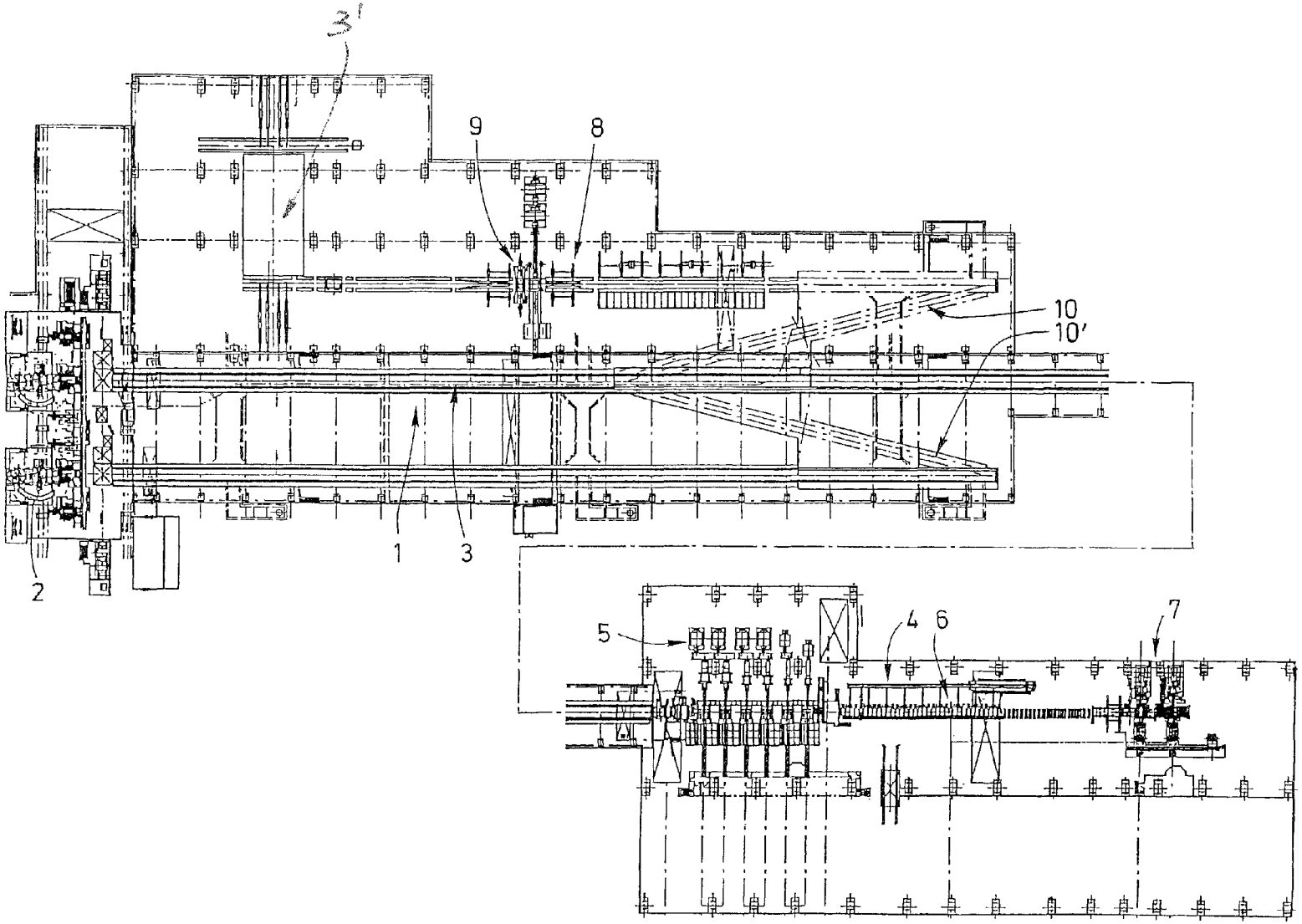
1
2
3
4
5
6
7
8
9
10
10'
13

CSP-CONTINUOUS CASTING PLANT WITH AN ADDITIONAL ROLLING LINE

CROSS-REFERENCE TO RELATED APPLICATIONS

This application is a continuation-in-part of application Ser. No. 12/928,386, filed Dec. 9, 2010, which is a continuation-in-part of application Ser. No. 11/579,932, filed Nov. 7, 2006, which is a is a national phase of PCT application No. PCT/EP2005/012900, filed Dec. 2, 2005, which claims priority to DE patent application No. 102004058550.4, filed Dec. 3, 2004, all of which are incorporated herein by reference.

BACKGROUND OF THE INVENTION

1. Field of the Invention

The invention relates to a continuous casting plant including at least one continuous casting line, optionally, at least one reducing unit, at least one separation device, and one or more devices for tempering the strip, and a downstream rolling train.

2. Description of the Prior Art

The so-called CSP-plants (Compact Strip Production) provide for a continuous and significantly shorter production of hot-rolled strips. Liquid steel is poured from a ladle in a tundish and from the tundish with a pouring tube in a mold. The mold has a shape in form of a funnel that is reduced on both parallel broad sides only in a last third of its height. The mold shape corresponds to a typical contraction course of a cooled steel. The advantage of a funnel, among others, is seen in that steel solidifies substantially stress-free and trouble-free. The rapidly solidified, in this manner, thin slabs having a thickness of about 50 mm are separated by shears before they are heated to a uniform temperature of 1,500° in a conveyor-furnace. Finally, rolling in a finishing train takes place, with finished slabs having a width from 900 to 1600 mm and thickness from 0.8 to 6.53 mm. For producing very thin sheets, six or seven very powerful rolling mill stands are used. Finally, the strip travels over a long cooling line to reels which wind the strip up into a coil. With CSP-plants, a high-quality hot-rolled strip is produced with favorable profile characteristics, better surface quality, and narrow tolerances.

The European Patent EP 1 363 750 B1 discloses a method for operating a continuous casting-rolling plant including at least one slab production line and at least one rolling mill train and further at least one slab-feeding device which technically is independent from the slab production line.

During a production interval of the slab production line, the slab feeding device takes over the delivery of slabs to the rolling mill train in accordance with logistic and/or manufacturing standards up to a maximum output possible. The mentioned further slab-production line is formed as a thick-slab production line, whereby the slab feeding device of the casting-rolling plant receives the slabs from a slab storage in which the prefabricated slabs are tempered during a manufacturing process. Those are reduced in a separate break-down train to a coil-adapted thickness. The coils are fed behind the casting plant immediately to the rolling train.

U.S. Pat. No. 7,143,499 discloses a plant for producing metal sheets of strips from carbon steels and special steels. The plant has a main casting line for producing stock form one type of steel, e.g., carbon steel, and including a rolling mill train and reheating furnace, arranged upstream of the rolling mill train and which reheat the strand fed from a casting machine for casting carbon steel slabs. The plant further includes an auxiliary line for feeding steel slabs, which are produced for a different type of steel, e.g., special steels, to the rolling mill train in the main casting line. The auxiliary line is connected with a casting machine for casting special steels and includes likewise a reheating furnace for heating the slab produced in the casting machine for casting slabs from special steels. The rolling mill train program is adapted to a given material to be rolled in the rolling mill train. The slabs are transmitted from the auxiliary line to the main line by a ferry. The auxiliary line may include a break-down stand for reducing the thickness of slabs produced in the casting machine for casting slabs from special steel to the rolling thickness of slabs in the rolling mill train of the main line if the thickness of the special steel slabs is greater.

The object of the present invention is increase of production of a CSP-plant and expanding its capabilities.

SUMMARY OF THE INVENTION

This and other objects of the present invention, which will become apparent hereinafter, are achieved by providing a continuous casting plant having a CSP-continuous casting line including metal casting machine, a separation device for separating a solidified cast stock in thin slab length, tempering means located downstream of the separating device, and a rolling mill train for reducing thickness of the thin slab length at least one further rolling line connectable with a casting machine and arranged parallel to the CSP-continuous casting line for reducing thickness of slab formats having a thickness that exceeds an entry thickness of CSP-continues casting line to the entry thickness of the at least one CSP-continuous casting line and having at least one of a multi-stand break-down train and a sheet rolling mill train for reducing thickness of the slabs having an increased thickness, and means located downstream of the sheet rolling mill train for continuously inwardly transferring thickness-reduced slab formats into the CSP-continuous casting line.

By the inward transferring of slab formats, the thickness of which is reduced to an entry thickness of the CSP-casting line from a parallel rolling line, increase in production is achieved by the maximal use of the downstream rolling line and an unlimited use of different steel goods.

According to the further development of the invention, for continuously inward transferring of slabs in a CSP-continuous casting line, there are provided pivoting or parallel conveyors. Thereby, among others, it is possible to inspect slabs deliverable from the parallel rolling line for processing and to undertake, if necessary, the necessary secondary treatment.

In the embodiment of the inventive continuous casting plant, it is contemplated that the pivoting or parallel conveyors are formed at least partially as hearth furnaces, in particular, as roller hearth furnaces. Thereby, an optimal heating process and an optimal temperature equalization for the inwardly transferred slabs is possible.

A further improvement of the continuous casting plant contemplates that the pivoting conveyors have a transporting device running in a direction opposite the transportation direction of the continuous casting plant, whereby the entire continuous casting plant is made very compact.

An ideal development of the continuous casting plant contemplates that the parallel rolling line has hearth furnace and a break-down train with horizontal and vertical edging stands or a sheet rolling mill train for reducing the thickness of the inwardly transferable slabs to an entry thickness necessary for a CSP-plant, e.g., between 40 and 70 mm.

With the inventive features, it is advantageously achieved that the continuous casting plant can be followed by one or more tandem-stand rolling mill trains as finishing trains, so that the CSP-plant with a noticeable production increase and expansion for all of the conveyed goods is formed.

The invention will be explained in detail based on a schematically shown embodiment.

BRIEF DESCRIPTION OF THE DRAWINGS

Single FIGURE of the Drawings shows a CSP-plant with a double-strand continuous casting installation with parallel rolling lines for transferring slabs in a continuous casting plant by a pivot process, and a downstream finishing line.

DETAILED DESCRIPTION OF THE PREFERRED EMBODIMENT

In a continuous casting plant 1, liquid steel is poured from a pan furnace 2 into an intermediate vessel, not shown in detail, and therefrom is poured with a pouring tube, likewise not shown in detail, in a funnel mold. From the funnel mold, the solidified steel is deflected by a guide into a horizontal roller table and is separated there by separation device in thin slab lengths. The thin slabs are fed in a roller hearth furnace 3 for heating to a uniform temperature of about 1150° C., in which the temperature is tempered. The separated thin slabs with a thickness of about 50 mm are delivered into a downstream finishing train 4 in which a thin slab is reduced in several stands 5 to a thickness of from 0.8 to 6.35 mm. The rolled strip is finally fed in a cooling line 6 with a laminar cooling and, finally, is wound up with a reel 7, forming a coil.

In order to increase production of the above-described CSP-plant and to be able to expand the to-be-conveyed goods, next to the continuous casting line, there is arranged a parallel rolling line 8, e.g., with a furnace 3' for conventional thick slabs or medium-thick slabs, and with a two-stand break-down train 9 or a sheet rolling mill train. In the break-down or sheet rolling train, the slabs, which are to be transferred in the continuous casting line, are reduced to CSP-plant entry thicknesses of about 50 mm. These slabs are continuously transferred from the rolling line 8 in the CSP-line by pivoting or parallel conveyors 10 or 10', and are heated in the roller hearth furnace arranged therein to the necessary rolling temperature, and their temperature is so tempered that they can finally be fed to the downstream finishing train 4 and are rolled there in a known manner, cooled, and can be wound up into coils.

What is claimed is:

1. A continuous casting plant, comprising a CSP-continuous casting line having metal casting means, a separation device for separating a solidified cast stock in thin slab length, tempering means located downstream of the separating device, and a rolling mill train for reducing thickness of the thin slab length; at least one further rolling line arranged parallel to the CSP-continuous casting line for reducing thickness of slab formats having a thickness that exceeds an entry thickness of the CSP-continuous casting line, the at least one further rolling line having a furnace for the slab formats the thickness of which exceeds the entry thickness of the CSP-continuous casting line, at least one of break-down train and a sheet rolling mill train located downstream of the furnace for reducing the thickness of the slab formats with the thickness exceeding the entry thickness of the CSP-continuous casting line to the entry thickness of the CSP-continuous casting line; and a pivoting conveyor located downstream of one of break-down train and the sheet rolling mill train for continuously inwardly transferring thickness-reduced slab formats into the CSP-continuous casting line.

2. A continuous casting plant according to claim 1, wherein the thickness of the inwardly transferrable stabs is reduced to 40-70 mm.

3. A continuous casting plant according to claim 1, wherein the rolling mill train is a finishing train and wherein a cooling line and a reel are arranged downstream of the finishing train.

4. A continuous casting plant according to claim 3, further comprising shears arranged downstream of the cooling line.

5. A continuous casting plant according to claim 1, wherein the at least one break-down train comprises horizontal and vertical edging stands.

6. A continuous casting plant according to claim 1, wherein the pivoting conveyor is formed, at least partially, as a hearth furnace.

* * * * *